US011600921B1

(12) United States Patent
Chen et al.

(10) Patent No.: US 11,600,921 B1
(45) Date of Patent: Mar. 7, 2023

(54) DUAL BAND ANTENNA AND ELECTRONIC DEVICE USING THE SAME

(71) Applicant: USI Science and Technology (Shenzhen) Co., Ltd., Shenzhen (CN)

(72) Inventors: Shing-Hau Chen, Shenzhen (CN); Hung-Wei Chiu, Shenzhen (CN); Jui-Chih Chien, Shenzhen (CN); Shun-Chuan Yu, Shenzhen (CN)

(73) Assignee: USI SCIENCE AND TECHNOLOGY (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 17/565,537

(22) Filed: Dec. 30, 2021

(30) Foreign Application Priority Data

Oct. 15, 2021 (CN) ..... 202111202089.6

(51) Int. Cl.
*H01Q 5/364* (2015.01)
*H01Q 1/24* (2006.01)
*H01Q 7/00* (2006.01)
*H01Q 9/40* (2006.01)

(52) U.S. Cl.
CPC ..... *H01Q 5/364* (2015.01); *H01Q 1/243* (2013.01); *H01Q 7/00* (2013.01); *H01Q 9/40* (2013.01)

(58) Field of Classification Search
CPC ..... H01Q 5/364; H01Q 1/243; H01Q 7/00; H01Q 9/40
See application file for complete search history.

(56) References Cited

U.S. PATENT DOCUMENTS

2009/0237307 A1* 9/2009 Tsai ..... H01Q 1/38 343/700 MS
2018/0131075 A1* 5/2018 Huang ..... H01Q 9/42
2018/0278287 A1 9/2018 Nishikawa et al.

FOREIGN PATENT DOCUMENTS

CN 108123729 A 6/2018
TW I347038 B 8/2011
TW I366950 B 6/2012

* cited by examiner

*Primary Examiner* — Daniel Munoz
(74) *Attorney, Agent, or Firm* — Li & Cai Intellectual Property (USA) Office

(57) ABSTRACT

A dual band antenna and an electronic device are provided. The dual band antenna includes a feed end, an annular connection end, a metal screw, a first extension path, a second extension path, a third extension path, and a grounding part. The annular connection end has an opening and is connected to the feed end. The metal screw has a threaded stud passing through the opening, so that the metal screw is electrically connected to the annular connection end. The feed end, the first extension path, the second extension path, the third extension path, and the grounding part are sequentially connected to each other. The dual band antenna is configured to have a monopole antenna and a loop antenna, so that the dual band antenna has a wide operating frequency band, and the monopole antenna operates at 3.6 GHz and the loop antenna operates at 4.6 GHz.

11 Claims, 6 Drawing Sheets

DUAL BAND ANTENNA AND ELECTRONIC DEVICE USING THE SAME

CROSS-REFERENCE TO RELATED PATENT APPLICATION

This application claims the benefit of priority to China Patent Application No. 202111202089.6, filed on Oct. 15, 2021 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna, and more particularly to a dual band antenna and an electronic device using the same.

BACKGROUND OF THE DISCLOSURE

Miniaturization of electronic products often results in spatial limitations when an antenna is disposed in the electronic product. Therefore, it can be difficult to meet requirements on frequency bands and specifications within limited space in the design of the antenna.

Common designs for reducing a size of the antenna include utilizing a chip antenna, using a high dielectric coefficient material as a carrier, etc. The chip antenna has a small volume, but an antenna operating bandwidth thereof is usually narrower, so that demands for communication systems nowadays cannot be fully met. Even though the use of the high dielectric coefficient material as the carrier can, through a cooperation of a three-dimensional design of the antenna and using the high dielectric coefficient material, effectively improve space utilization, but a process for manufacturing such an antenna is more difficult and involves higher costs.

SUMMARY OF THE DISCLOSURE

In response to the above-referenced technical inadequacies, the present disclosure provides a dual band antenna, which effectively improves a bandwidth of an antenna and can be applied to an electronic product with limited space to meet a specification requirement of the antenna.

In one aspect, the present disclosure provides a dual band antenna, which includes a feed end, an annular connection end, a metal screw, a first extension path, a second extension path, a third extension path, and a grounding part. The annular connection end has an opening and is connected to the feed end. The metal screw has a threaded stud passing through the opening, so that the metal screw is electrically connected to the annular connection end. The first extension path is connected to the feed end, the second extension path is connected to the first extension path, the third extension path is connected to the second extension path, and the grounding part is connected to the third extension path. The feed end, the annular connection end, and the metal screw are configured to form a monopole antenna, and the feed end, the first extension path, the second extension path, the third extension path, and the grounding part are configured to form a loop antenna.

In another aspect, the present disclosure provides an electronic device using the dual band antenna described above, and the metal screw is a screw of the electronic device that is used for fixing.

Therefore, one of the beneficial effects of the present disclosure is that, the dual band antenna is configured to have the monopole antenna and the loop antenna, so that the dual band antenna has a broadband operating frequency band, thereby broadening the frequency band of the antenna. Moreover, the monopole antenna operates at 3.6 GHz and the loop antenna operates at 4.6 GHz, so that a frequency band required for sub-6 GHz communication system can be covered.

In addition, the metal screw is designed as a part of the antenna, especially as the monopole antenna, so that the monopole antenna can be easily formed and a cost thereof can be lowered. Moreover, the metal screw can be directly applied to the electronic product by a fixing property thereof.

Furthermore, through designing the metal screw as the part of the antenna, a metal material and a substrate material needed for the monopole antenna can be omitted, so that a design cost of the antenna can be significantly reduced. Moreover, a space occupied by a path can be simplified in the monopole antenna, thereby reducing an overall size of the dual band antenna.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
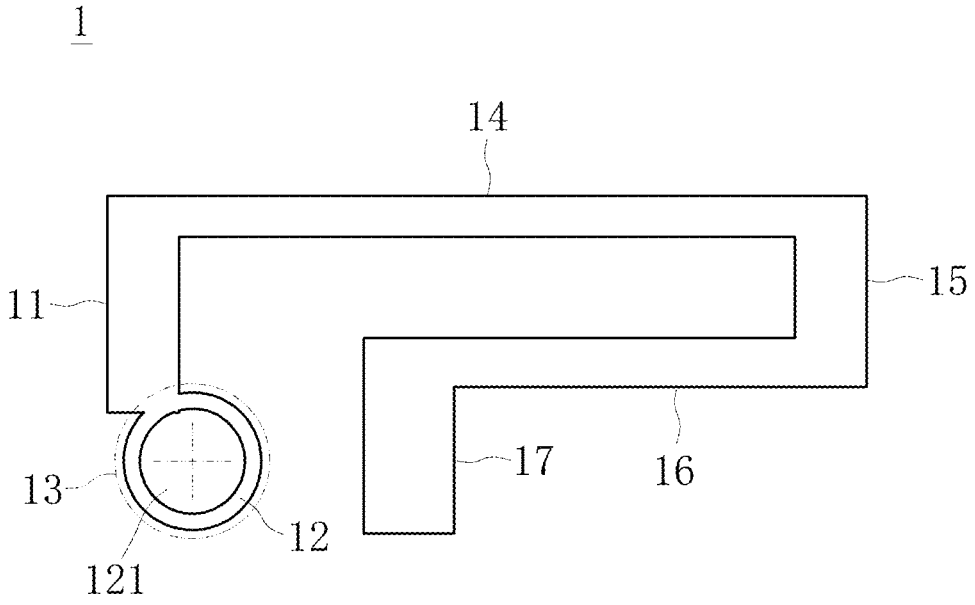
FIG. 1 is a schematic structural view of a dual band antenna according to one first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

EMBODIMENTS

The present disclosure provides a dual band antenna that can be applied to an electronic device. The electronic device can be an intelligent electronic device or a portable electronic device, such as a mobile phone, an industrial mobile phone, and a tablet computer, but the present disclosure is not limited to any kind of electronic devices. In addition, the dual band antenna of the present disclosure does not exclude the one that operates independently for signal transmission and reception with the electronic device. The dual band antenna of the present disclosure is made of a metal screw as one part of the dual band antenna, and a remaining part of the dual band antenna can be made of a metal foil, such as a copper foil, or a metal component, such as an iron component and an aluminum alloy component. Moreover, the dual band antenna of the present disclosure has the metal screw disposed therein so that a problem of signal shielding when the antenna is disposed in the electronic device can be alleviated or avoided altogether. Therefore, a design difficulty for disposing the antenna in the electronic device can be simplified, and a design size of the antenna can be reduced, thereby improving a signal transmission effect of the antenna.

The dual band antenna of the present disclosure can also support a specific communication protocol, so that the dual band antenna can support, for example, a multi-input multi-output (MIMO) communication technology, when being disposed in a mobile electronic device, which requires the dual band antenna with two frequency bands to implement the MINO communication technology. An interference of antenna transmission can be reduced or avoided in the dual band antenna with two frequency bands of the present disclosure, and a size of the antenna can be reduced, thereby improving a performance of the MIMO communication technology.

The dual band antenna of the present disclosure can cooperate with and be designed for various product applications, and is suitable for application in products of which an overall thickness is not strictly required, such as industrial electronic machines and smart watches.

Figure 2:
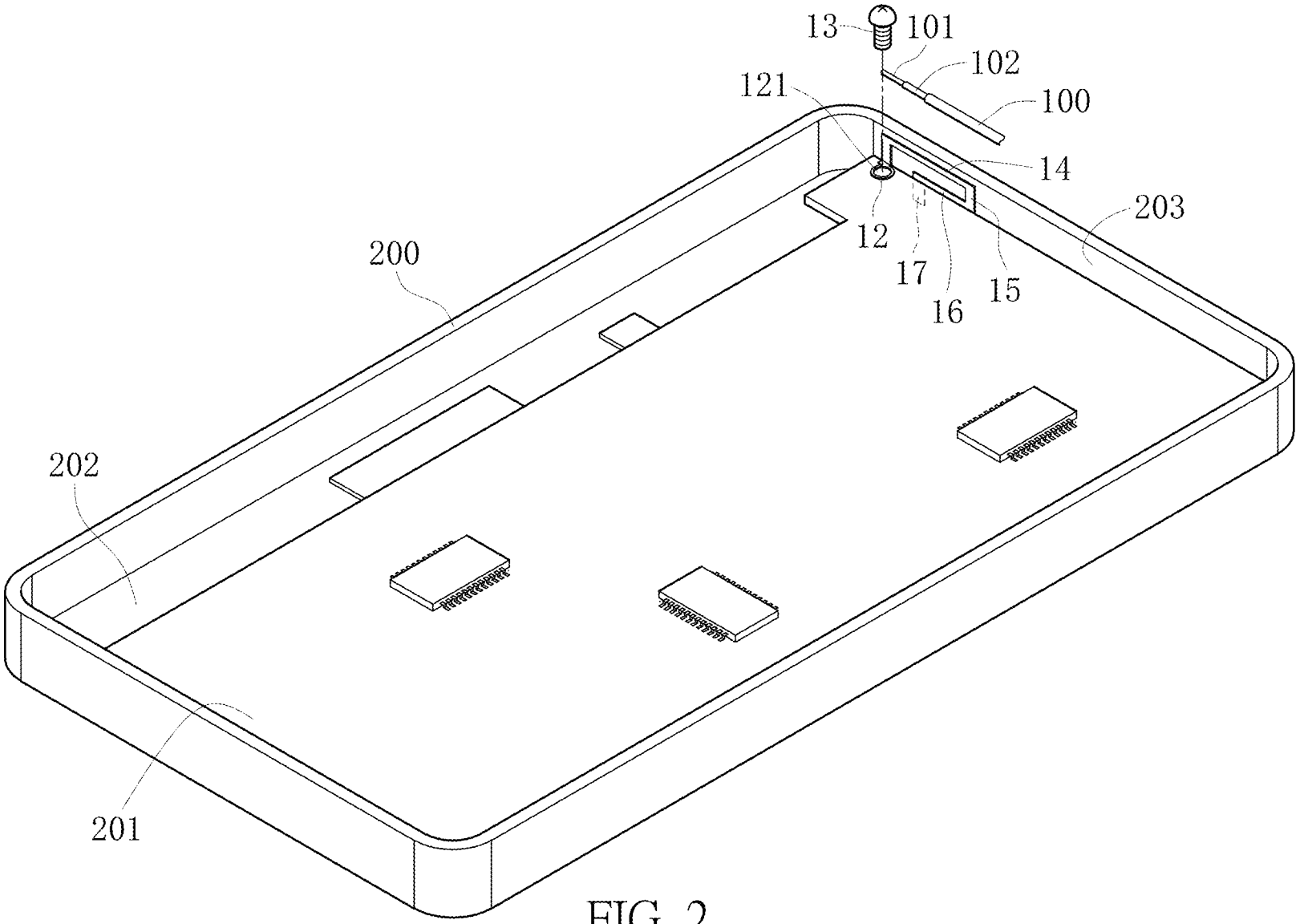
FIG. 2 is a schematic circuit diagram of the dual band antenna used in an electronic device according to one embodiment of the present disclosure.

According to one embodiment of the present disclosure, and referring to FIG. 1 and FIG. 2, FIG. 1 is a schematic structural view of a dual band antenna according to one embodiment of the present disclosure, and FIG. 2 is a schematic structural view of the dual band antenna used in an electronic device according to one embodiment of the present disclosure.

The present disclosure provides a dual band antenna 1, which includes, but is not limited to, a feed end 11, an annular connection end 12, a metal screw 13, a first extension path 13, a second extension path 15, a third extension path 16, and a grounding part 17, thereby forming a radiator structure of the dual band antenna 1.

In one embodiment, the feed end 11 servers as a signal feed end shared by two paths in the dual band antenna 1. One of the two paths includes the feed end 11, the annular connection end 12, and the metal screw 13 that is configured to be a monopole antenna, and another one of the two paths includes the feed end 11, the first extension path 14, the second extension path 15, the third extension path 16, and the grounding part 17 that is configured to be a loop antenna.

The annular connection end 12 has an opening 121, and the annular connection end is connected to the feed end 11. A threaded stud of the metal screw 11 passes through opening 121, so that the metal screw 13 is electrically connected to the annular connection end 12. The metal screw 13 is electrically connected to the annular connection end 12 in the following manner. When the threaded stud of the metal screw 13 passes through the opening 121, a head of the metal screw 13 (i.e., a top of the metal screw 13) abuts an upper surface of the annular connection end 12, and when the annular connection end 12 includes a copper foil tape, a copper foil part of the annular connection end 12 is electrically connected to the head of the metal screw 13 in a contacting manner, and is simultaneously connected to the loop antenna.

The first extension path 14 is connected to the feed end 11, and the first extension path 14, the second extension path 15, and the third extension path 16 are sequentially connected to each other, i.e., the second extension path 15 is connected to the first extension path 14, and the third extension path 16 is connected to the second extension path 15. In one embodiment, the feed end 11, the first extension path 14, the second extension path 15, the third extension path 16, and the grounding part 17 can be electrically connected to each other sequentially, or can be integrally formed, but the present disclosure is not limited thereto.

Accordingly, the grounding part 17 is connected to the third extension path 16, so as to adjust an impedance matching property of the antenna. A width, a length, and a shape of the first extension path 14 to the third extension path 16, or an area and a shape of the grounding part 17 can be adjusted to achieve a good impedance matching property, so that the signal transmission and reception of the loop antenna can be adjusted or application to a specific operating frequency band can be achieved.

In one embodiment, the feed end 11, the first extension path 14, the second extension path 15, the third extension path 16, and the grounding part 17 can be connected to each other sequentially to form a rectangle, but is not limited thereto. In addition, an angle for arranging each of the radiators is not limited to those shown in the figures, but can be adjusted according to practical requirements associated with available space in electronic products.

In one embodiment, the feed end 11 and the first extension path 14 can have an angle arranged therebetween, the first extension path 14 and the second extension path 15 can have the angle arranged therebetween, the second extension path 15 and the third extension path 16 can have the angle therebetween, and the third extension path 16 and the grounding part 17 can have the angle arranged therebetween, so that an area and a volume of the overall dual band antenna 1 can be significantly reduced.

In one embodiment, the monopole antenna and the loop antenna of the dual band antenna 1 can be designed to be perpendicular to each other, and in particular, the metal screw 13 is perpendicular to the loop antenna, so that, when the dual band antenna of the present disclosure is disposed in an electronic device 200, the dual band antenna 1 can fit a specific position in a limited space of the electronic device 200. Moreover, a relative arrangement of the monopole antenna and the loop antenna in the electronic device 200 is not limited to that disclosed herein.

In one embodiment, the loop antenna can be disposed on a substrate using a flexible printed circuit (FPC) board in the electronic device 200, so that the loop antenna can be disposed in the electronic device 200 in a flexible manner or a laminated manner, but not excluding a manner where a rigid printed circuit board is disposed thereon.

In one embodiment, the dual band antenna 1 of the present disclosure can be connected to a feed line 100, which has a signal feed end 101 connected to the feed end 11 of the dual band antenna 1, and a signal grounding end 102 of the feed line 100 is connected to the grounding part 17, so that the signal transmission of the dual band antenna 1 can be conducted therethrough. In addition, the signal transmission of the dual band antenna 1 of the present disclosure can also be conducted by a signal processing circuit of the electronic device 200 after the dual band antenna 1 is disposed in the electronic device 200, but the present disclosure is not limited thereto.

In one embodiment, the annular connection end 12 and the feed end 11 of the dual band antenna 1 can have the angle arranged therebetween. In addition, the annular connection end 12 can form a complete ring, the feed end 11 can form a complete rectangle, and the annular connection end 12 and the feed end 11 can be connected to each other through edge contact or partial fusion, so as to adjust a current path, but the present disclosure is not limited thereto.

Figure 3:
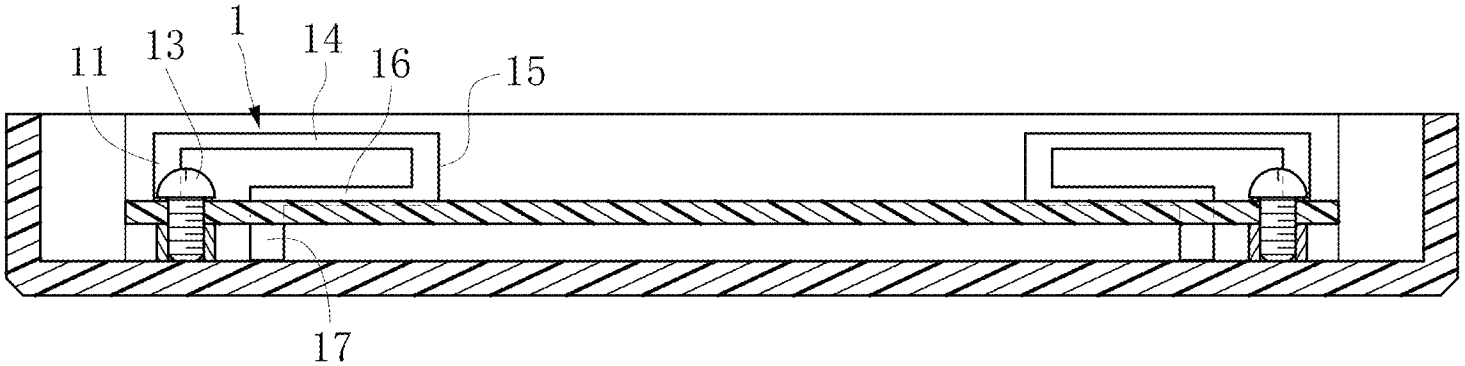
FIG. 3 is a schematic structural view illustrating a vertical design of a metal screw of a monopole antenna relative to a housing of the electronic device, and a horizontal design of a loop antenna relative to the housing of the electronic device according to one embodiment of the present disclosure.

In one embodiment, and referring to FIG. 3, FIG. 3 is a schematic structural view illustrating a vertical design of the metal screw of the monopole antenna relative to a housing of the electronic device, and a horizontal design of the loop antenna relative to the housing of the electronic device according to one embodiment of the present disclosure.

When the dual band antenna 1 is disposed in the electronic device 200, the metal screw 13 can be a screw of the electronic device 200 that is used for fixing. As shown in FIG. 2 and FIG. 3, after the head of the metal screw 13 of the monopole antenna is electrically connected to the annular connection end 12, the metal screw 13 is fixedly engaged with a circuit board 201 of the electronic device 200 (or with the housing of the electronic device 200), so that the metal screw 13 can be used as a part of the radiator, thereby saving an area and a volume occupied by disposing the antenna.

In one embodiment, multiple ones of the dual band antennas 1 can be disposed at a plurality of positions at a periphery of the electronic device 200, such as a plurality of corners of the electronic device 200, so as to be suitable for the performance of the MIMO communication technology. In addition, the metal screw 13 can be directly fixed to a position on the electronic device 200, such as the circuit board 201 and the housing, or can be fixed to the position of the electronic device 200 through the housing of the electronic device 200. The position for the metal screw 13 is for purposes of illustration only, and the metal screw 13 can pass through the housing of the electronic device 200 and be fixedly engaged with the electronic device 200 based on a design of the electronic device 200, but the present disclosure is not limited thereto.

In one embodiment, through a vertical design of the metal screw 13 as the monopole antenna relative to one side surface 202 of the housing of the electronic device 200 and a horizontal design of the loop antenna relative to another side surface 203 of the housing of the electronic device 200, current flows of the monopole antenna and the loop antenna are orthogonal to each other, so that an overall coverage of antenna pattern is more uniform, and the antenna pattern does not have a directivity.

In one embodiment, in addition to using the screw of the electronic device 200 that is used for fixing as the metal screw 13 and as the part of the antenna, an additional screw of a specific specification can also be used as the part of the radiator of the monopole antenna. The metal screw 13 has a length of 8 mm and a width of 4 mm. The metal screw 13 is electrically connected to the copper foil tape of the annular connection end 12, and is electrically connected to the loop antenna on a side wall of the housing of the electronic device. Alternatively, the metal screw 13 can have the length of 6 mm or 7 mm.

In one embodiment, when the metal screw 13 serves as the part of the monopole antenna and the metal screw 13 has the length of 8 mm, a length of current path of the monopole antenna (including a part of copper foil path contributed by the annular connection end 12) is about 10 mm, and a length of current path of the loop antenna is about 20 mm. When the metal screw 13 has the length of 6 mm, the length of current path of the monopole antenna (including the part of copper foil path formed by the annular connection end 12) is about 7.5 mm, and the length of current path of the loop antenna is about 25 mm, but is not limited thereto. A shorter one of metal screw 13 is more suitable for thin and light consumer electronics.

Figure 4:
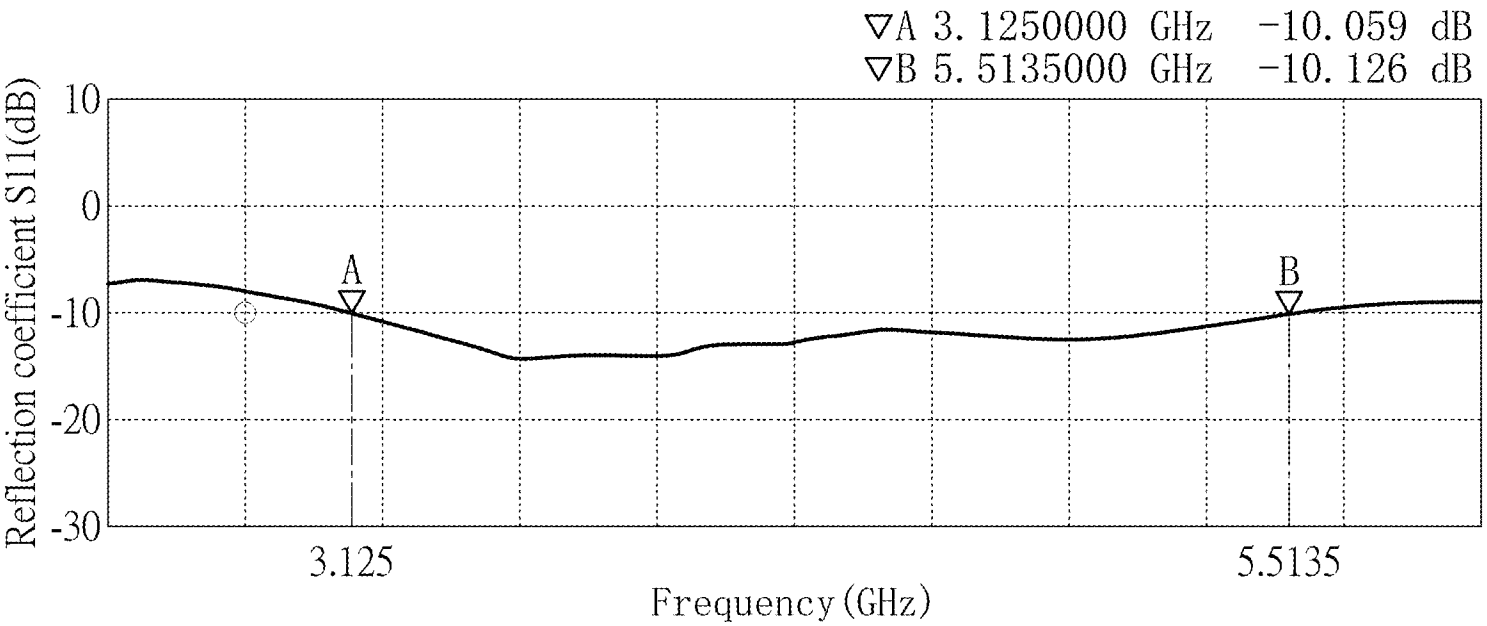
FIG. 4 shows a reflection coefficient of the dual band antenna operating in a frequency band of 3.125 GHz to 5.5135 GHz according to one embodiment of the present disclosure.

In one embodiment, and referring to FIG. 4, FIG. 4 shows a reflection coefficient of the dual band antenna operating in a frequency band of 3.125 GHz to 5.5135 GHz according to one embodiment of the present disclosure. The frequency band as shown in the figure is merely to show actual data when measuring a characteristic of the antenna, and is not intended to limit the characteristic and the operating frequency band of the antenna. As shown in FIG. 4, and taking a simulation diagram of the reflection coefficient S 11 as an example, the impedance matching property is good, thereby improving the transmission and reception of the antenna. That is, when the operating bandwidth ranges from 3.13 GHz to 5.51 GHz, an effect of −10 dB or less can be achieved, and such the operating bandwidth can cover a frequency band (e.g., 3.3 GHz to 5 GHz) used in a sub-6 GHz communication system. Furthermore, the reflection coefficient S 11 can also be referred as a return loss.

Figure 5:
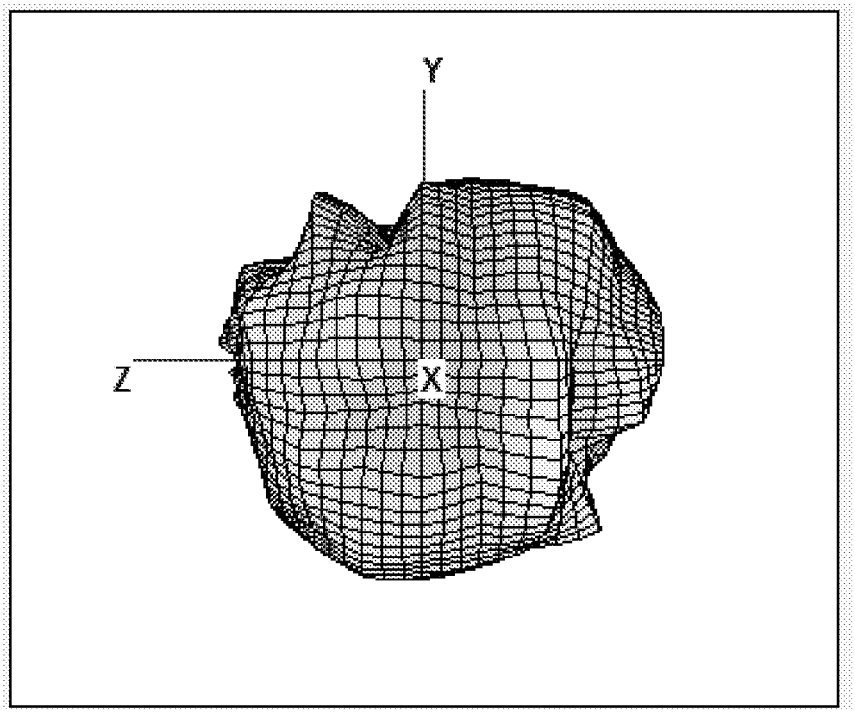
FIG. 5 is a schematic radiation pattern of the monopole antenna of the dual band antenna operating at 3.6 GHz and viewed from a front of an XYZ axis according to one embodiment of the present disclosure.
Figure 6:
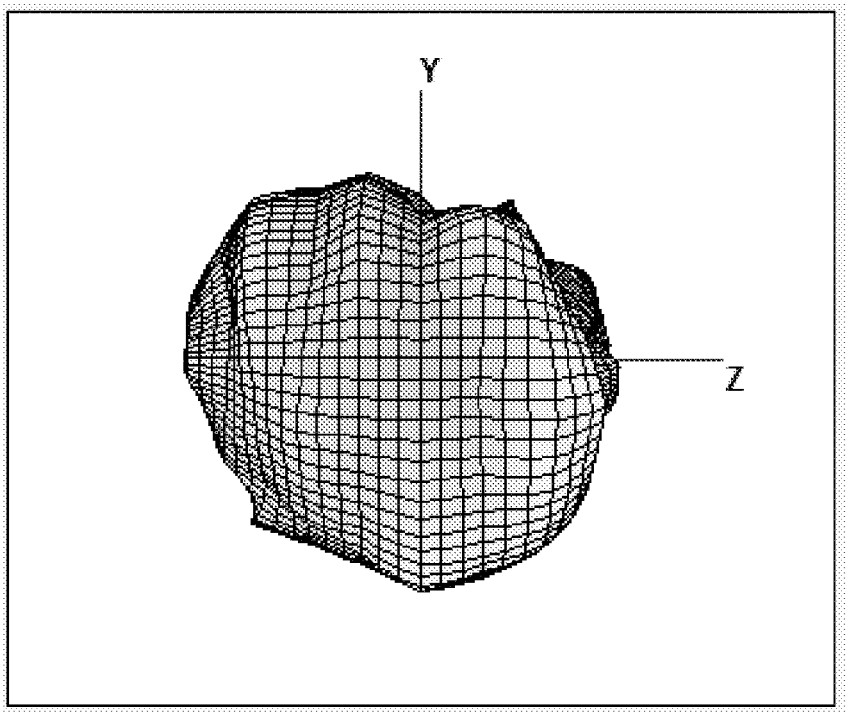
FIG. 6 is a schematic radiation pattern of the monopole antenna of the dual band antenna operating at 3.6 GHz and viewed from a back of the XYZ axis according to one embodiment of the present disclosure.
Figure 7:
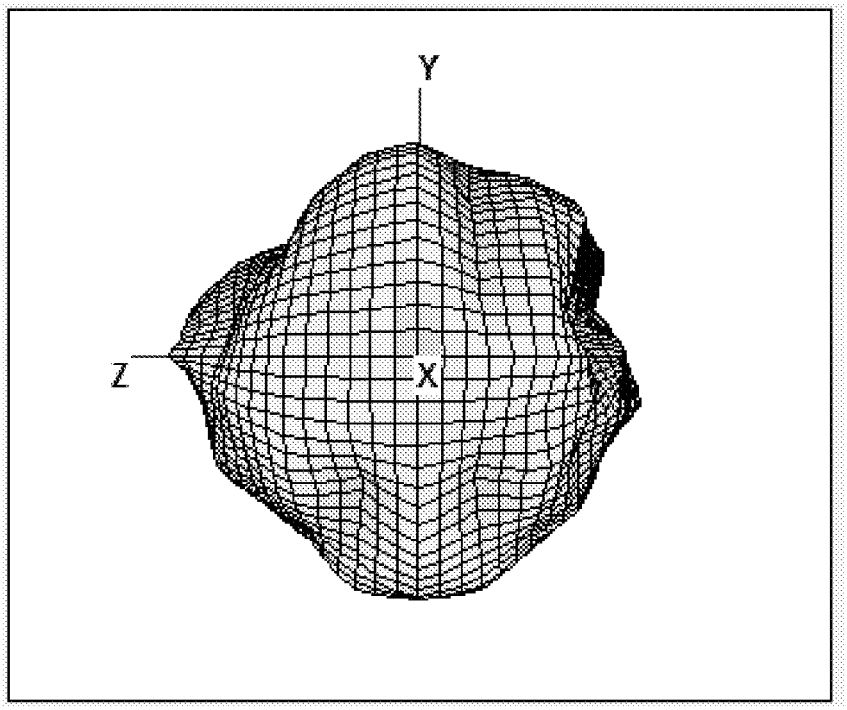
FIG. 7 is a schematic radiation pattern of the loop antenna of the dual band antenna operating at 4.6 GHz and viewed from the front of the XYZ axis according to one embodiment of the present disclosure.
Figure 8:
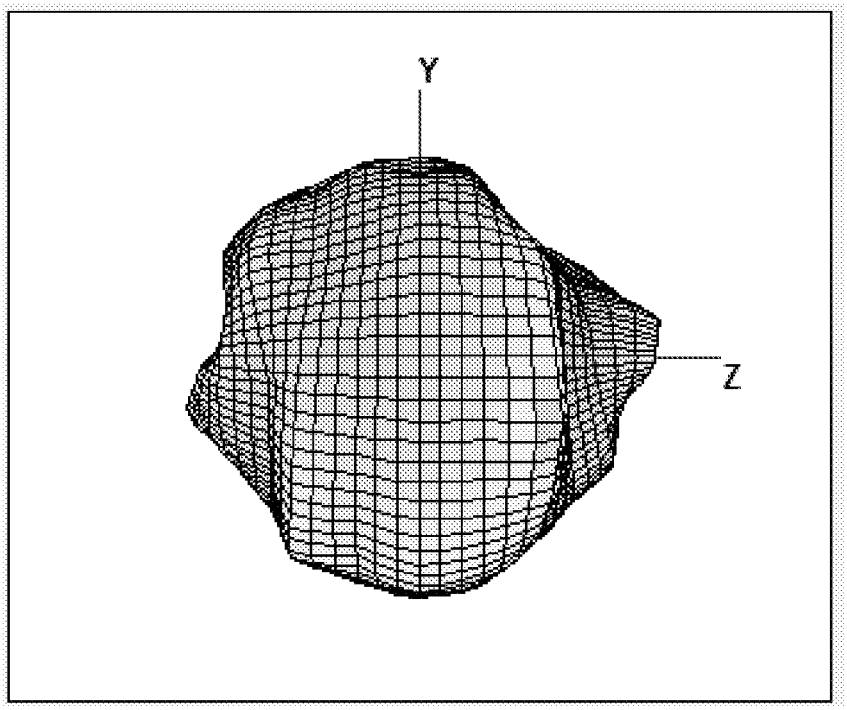
FIG. 8 is a schematic radiation pattern of the loop antenna of the dual band antenna operating at 4.6 GHz and viewed from the back of the XYZ axis according to one embodiment of the present disclosure.

Referring to FIG. 5 to FIG. 8, FIG. 5 is a schematic radiation pattern of the monopole antenna of the dual band antenna operating at 3.6 GHz and viewed from a front of an XYZ axis according to one embodiment of the present disclosure, FIG. 6 is a schematic radiation pattern of the monopole antenna of the dual band antenna operating at 3.6 GHz and viewed from a back of the XYZ axis according to one embodiment of the present disclosure, FIG. 7 is a schematic radiation pattern of the loop antenna of the dual band antenna operating at 4.6 GHz and viewed from the front of the XYZ axis according to one embodiment of the present disclosure, and FIG. 8 is a schematic radiation pattern of the loop antenna of the dual band antenna operating at 4.6 GHz and viewed from the back of the XYZ axis according to one embodiment of the pre sent disclosure.

In one embodiment, the dual band antenna 1 of the present disclosure supports a first resonant mode that corresponds to the frequency band of 3.6 GHz (as shown in FIG. 5 and FIG. 6), and a second mode that corresponds to the frequency band of 4.6 GHz (as shown in FIG. 7 and FIG. 8). That is, the first resonant mode is a mode in which the monopole antenna generates an approximately quarter wavelength at 3.6 GHz, whereby the monopole antenna resonates at 3.6 GHz, and the second mode is a mode in which the loop antenna generates an approximately half wavelength at 4.6 GHz, whereby the loop antenna resonates at 4.6 GHz. The present disclosure is not limited to the frequency band corresponding to the resonant mode. Moreover, a length of an overall resonant path of the dual band antenna 1 is required to be designed, so that the dual band antenna 1 of the present disclosure can support the two resonant modes simultaneously. Through selecting the length of the overall resonant path, the resonant path of the dual band antenna 1 can be configured so that the dual band antenna 1 can support both the first resonant mode that corresponds to the monopole antenna and the second resonant mode that corresponds to the loop antenna, and a radiation gain of the antenna can be improved when a resonant condition is satisfied. For example, the antenna gains at the operating frequency bands of 3.6 GHz and 4.6 GHz provided by the present disclosure are 0.3 dBi and 0.6 dBi, respectively.

BENEFICIAL EFFECTS OF THE EMBODIMENTS

In conclusion, one of the beneficial effects of the present disclosure is that, the metal screw is used as the monopole antenna, and the cooperation of the monopole antenna and the loop antenna results in the operating frequency band of the antenna. The monopole antenna operates at the resonant frequency of the quarter wavelength, and the loop antenna operates at the resonant frequency of the half wavelength. Such two bandwidths can cover the frequency band (e.g., 3.3 GHz to 5 GHz) used in the sub-6 GHz communication system.

The dual band antenna of the present disclosure can be applied to miniaturized electronic products, so that the antenna having the broadband can be designed for a limited space of the electronic product. The metal screw is used as the monopole antenna branch, and through the cooperation of the loop antenna, the range of operating bandwidth can be significantly increased, and the operating frequency band of 3.12 GHz to 5.5 GHz can be covered when the return loss is −10 dB or less.

The conventional screw can be used in the limited space of the electronic product, so that the size of the antenna can be reduced (i.e., the space occupied by the antenna and a cost for manufacturing the antenna can be reduced). In addition, the antenna can be designed to have the wide operating frequency band, which can cover the required frequency band of sub-6 GHz communication system. Furthermore, the antenna gains at the operating frequency bands of 3.6 GHz and 4.6 GHz respectively are 0.3 dBi and 0.6 dBi, and a performance efficiency of the antenna is about 40% to 50%. In addition, the antenna pattern does not have the directivity, and the overall coverage of the antenna pattern is more uniform, so that the problem of signal shielding can be reduced when the dual band antenna of the present disclosure is applied to the electronic device.

Furthermore, when the loop antenna including the FPC is configured to be disposed on the side of the electronic product, such as a mobile phone, and the metal screw is used as the antenna, the metal screw is used as the monopole antenna. The metal screw has the length and the width of 8 mm and 4 mm, respectively, and the copper foil tape is used as the contact between the antenna and the metal screw. When the metal screw is fixed to the electronic product (e.g., fixed to the housing), the metal screw comes in contact with the copper foil. Such design of the antenna results in a reduction of metal material required for the antenna, so that the monopole antenna operates at 3.6 GHz at the quarter wavelength. In addition, the another one of the two paths of the dual band antenna, i.e., the loop antenna, is attached to the side of the electronic product, so that the loop antenna operates at 4.6 GHz at the half wavelength. Through the cooperation of the two operating modes described above, the dual band antenna can be applied to broadband communication, and has the operating bandwidth covering the frequency range of 3.5 GHz to 5.5 GHz.

The present disclosure can also be applied to arrange and design the two antennas of the dual band antenna according to the demands of various electronic products, thereby reducing a design limitation caused by the limited space of the electronic product.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A dual band antenna, comprising:

a feed end;

an annular connection end having an opening, wherein the annular connection end is connected to the feed end, the opening is configured to receive the metal screw, the metal screw has a threaded stud passing through the opening, so that the metal screw is electrically connected to the annular connection end;

a first extension path connected to the feed end;

a second extension path connected to the first extension path;

a third extension path connected to the second extension path; and a grounding part connected to the third extension path;

wherein the feed end, the annular connection end, and the metal screw are configured to form a monopole antenna, and the feed end, the first extension path, the second extension path, the third extension path, and the grounding part are configured to form a loop antenna, the monopole antenna is perpendicular to the loop antenna, when the dual band antenna is disposed in an electronic device, the monopole antenna is disposed in a first side surface of the electronic device and the loop antenna is disposed in a second side surface of the electronic device, the first side surface and the second side surface are adjacent and perpendicular to each other.

2. The dual band antenna according to claim 1, wherein the metal screw has a length of 6 mm to 8 mm, and the metal screw has a width of 4 mm.

3. The dual band antenna according to claim 2, wherein the metal screw has a length of exactly 6 mm.

4. The dual band antenna according to claim 1, wherein the loop antenna includes a substrate using a flexible printed circuit board.

5. The dual band antenna according to claim 1, wherein the monopole antenna operates at a resonant frequency of a quarter wavelength, and the loop antenna operates at a resonant frequency of a half wavelength.

6. The dual band antenna according to claim 1, wherein the annular connection end includes a copper foil tape.

7. The dual band antenna according to claim 1, wherein current flows of the monopole antenna and the loop antenna are orthogonal to each other.

8. An electronic device using the dual band antenna as claimed in claim 1, wherein the metal screw is a screw of the electronic device that is used for fixing.

9. The electronic device according to claim 8, wherein multiple ones of the dual band antennas are disposed at a plurality of positions at a periphery of the electronic device.

10. The electronic device according to claim 8, wherein the metal screw is directly fixed to a position on the electronic device, or is fixed to the position on the electronic device through a housing of the electronic device.

11. An electronic device, comprising:

a housing, at least including a first side surface and a second side surface, the second side surface being perpendicular to the first side surface, the first side surface is adjacent to the second side surface;

a circuit board, being disposed at the first surface and parallel to the first side surface; and a dual band antenna, including:

a feed end;

an annular connection end having an opening, wherein the annular connection end is connected to the feed end, the opening is configured to receive the metal screw, the metal screw has a threaded stud passing through the opening, so that the metal screw is electrically connected to the annular connection end;

a first extension path connected to the feed end;

a second extension path connected to the first extension path;

a third extension path connected to the second extension path; and a grounding part connected to the third extension path;

wherein the feed end, the annular connection end, and the metal screw are configured to form a monopole antenna, and the feed end, the first extension path, the second extension path, the third extension path, and the grounding part are configured to form a loop antenna, the loop antenna is disposed on the second side surface and the monopole antenna is disposed at the circuit board on the first side surface.

* * * * *